US005863110A

United States Patent [19]

Swanson

[11] Patent Number: 5,863,110

[45] Date of Patent: Jan. 26, 1999

[54] SWING ARM LAMP WITH DISPLAY UNIT

[75] Inventor: Erik A. Swanson, Woodland Hills, Calif.

[73] Assignee: Lamps Plus, Inc., Chatsworth, Calif.

[21] Appl. No.: 597,418

[22] Filed: Feb. 8, 1996

[51] Int. Cl.[6] ..... F21V 21/26

[52] U.S. Cl. ..... 362/269; 362/275; 362/370

[58] Field of Search ..... 362/147, 269, 362/275, 287, 427, 801, 812, 370; 40/594, 617, 757, 759

[56] References Cited

U.S. PATENT DOCUMENTS

| | | | |
|---|---|---|---|
| 1,739,320 | 12/1929 | Lloyd | 40/757 |
| 3,488,875 | 1/1970 | Gant | 40/617 |
| 3,723,720 | 3/1973 | Schmidt et al. | 362/183 |
| 5,025,353 | 6/1991 | Menaged | 362/427 |

*Primary Examiner*—Y My Quach

*Attorney, Agent, or Firm*—Robbins, Berliner & Carson L.L.P.

[57] ABSTRACT

A wall mounted swing arm lamp with an integral display unit removably affixed to a base. Reinforcement is provided to the base to support the weight of the swing arm and the lamp when fully extended. The base and the display unit carry complementary attachment fittings for removably securing the display unit to the base.

7 Claims, 2 Drawing Sheets

FIG. 1
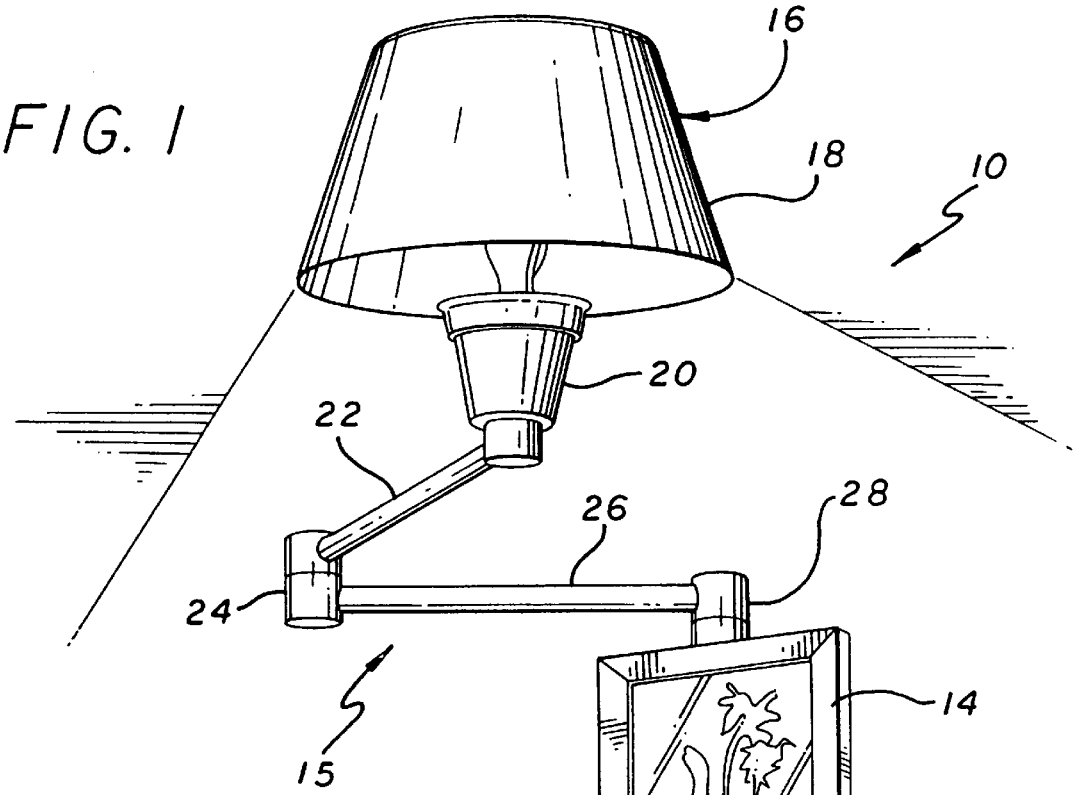
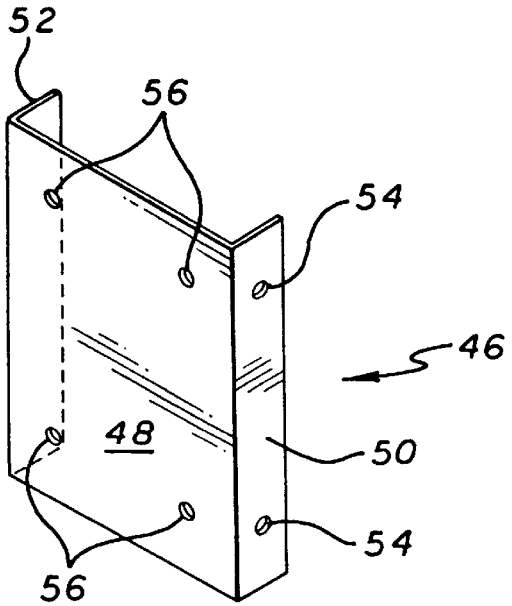
FIG. 3
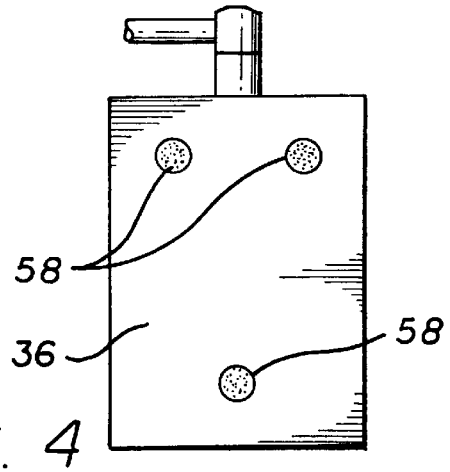
FIG. 4

SWING ARM LAMP WITH DISPLAY UNIT

BACKGROUND OF THE INVENTION

1. Field of the Invention

The present invention relates to electrical lighting means and more particularly to a wall mounted swing arm lamp having a display unit as an integral part thereof.

2. Prior Art

Wall mounted lamps are well known in the industry as are swing arm lamps, some of which are also wall mounted. Such lamps, particularly the wall mounted swing arm lamps, are typically utilized in bedrooms or seating areas, particularly where one wishes to read.

It is also well known to provide display units of all types, particularly, for example, such as frames within which photographs may be inserted. In some instances items other than photographs may be inserted, such for example, as drawings, graphs, charts, awards and the like which one desires to display for his or her own enjoyment or the enjoyment of others.

Although the lamps and particularly the wall mounted swing arm lamps have functioned quite well for the purpose of providing light for reading, it has been necessary for one to properly enjoy the items set forth in the display unit to properly illuminate them. Normally this has required the utilization of a separate flood, spot or dedicated frame mounted illumination means to accomplish this purpose. As a result the illumination means is dedicated solely for the purpose of illuminating the display unit as opposed to providing light for reading or to generally illuminate the surrounding area.

SUMMARY OF THE INVENTION

A lamp having a removable display unit which includes a base having a planar outer surface. A stem extends from the base unit and carries an illumination means. A plurality of complementary mounting means are affixed to the base plan or surface and the display unit for removably attaching the display unit to the planar outer surface of the base.

BRIEF DESCRIPTION OF THE DRAWINGS

FIG. 1 is a perspective view of a wall mounted swing arm lamp having a removable display unit affixed thereto mounted upon a wall;

FIG. 3 is a perspective view of the back mounting plate;

FIG. 4 is a view of the base unit having the mounting means affixed thereto;

DETAILED DESCRIPTION

Figure 2:
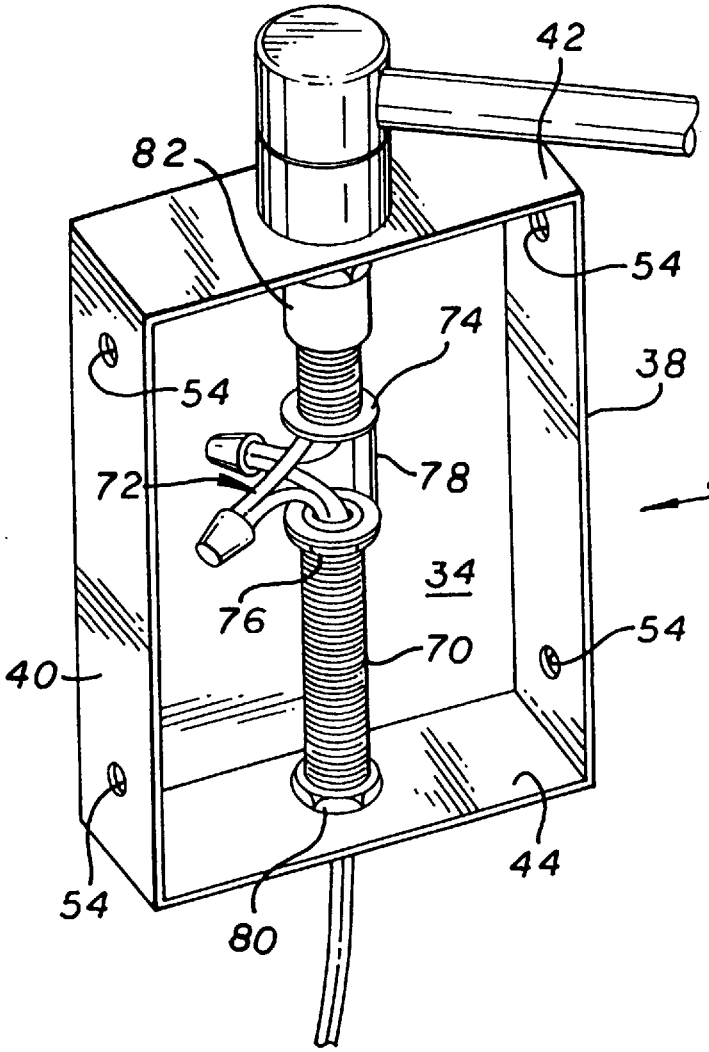
FIG. 2 is a fragmented perspective view of the lamp with the back cover removed from the base unit.

As is illustrated in FIG. 1 a wall mounted swing arm lamp with a display unit removably affixed thereto is shown generally at 10. The swing arm lamp 10 is affixed to a wall or similar structure, typically within a living space such as a bedroom. The combination in accordance with the present invention includes a display unit 14 such as a photograph frame containing a photograph 17 or similar type of subject matter such as a plaque which is to be displayed. Extending above the display unit 14 on a stem 15 is an illumination means 16 such as a lamp having an appropriate shade 18 which is mounted upon an appropriate frame (not shown) extending from the fixture 20. The fixture 20 is mounted upon an arm 22 which is connected by a swivel joint 24 to an additional arm 26. The arm 26 is in turn connected by a swivel joint 28 to a base unit which will be described more fully in detail below. Extending from the bottom of the base unit is an appropriate electrical cord 30 which is used to connect the illumination means 16 to a source of electricity by the typical electrical plug.

As will be recognized by those skilled in the art, by having the integral combination of the display unit 14 along with the illumination means 16, which may be appropriately positioned through the utilization of the swing arms 22 and 26, the light emanating from the illumination means 16 can be utilized for reading, for simultaneously illuminating the photograph 16 and otherwise to provide light to the general surrounding area. That is, the swing arm lamp may be used for the traditional purpose of reading or providing general lighting to a surrounding area while simultaneously illuminating the photograph 16 thus providing an unexpected dual purpose for the swing arm lamp.

As is shown in FIGS. 2, 3 and 4 the base unit 32 upon which the display unit 14 is mounted includes a front wall having an inner surface 34 and outer planar surface 36 (FIG. 4). Extending orthogonally from the front wall inner surface 34 are a pair of side walls 38 and 40 along with a top wall 42 and a bottom wall 44. A rear cover plate 46 is inserted in place with the back plate 48 covering the opening provided in the base unit 32. Orthoganally disposed flanges 50 and 52 extend coextensively with the side walls 38 and 40. Appropriate fasteners (not shown) are inserted through aligned openings 54 to secure the back plate to the side walls 38 and 40. As is also seen appropriate openings 56 are provided in the back plate 48 in order to secure the display unit to the wall 12.

As is shown particularly in FIG. 4 the base unit provides the outer planar surface 36 to which is affixed a plurality of fastening means such as those shown at 58. The outer planar surface 36 is the other side (not shown in FIG. 2) of the wall inner surface 34 and when the base unit is mounted on a wall or the like the outer planar surface and the fastening means 58 are exposed.

Figure 6:
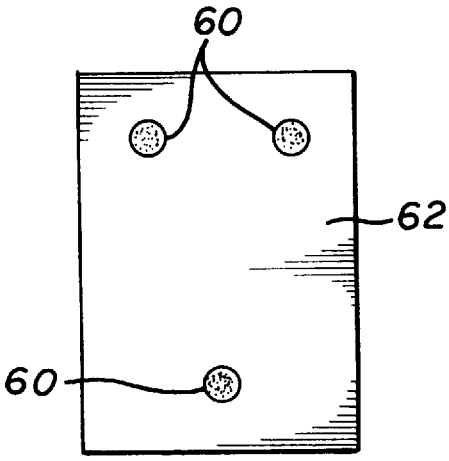
FIG. 6 is a rear view of a display unit also having the mounting means affixed thereto.

Complimentary fastening members 60 are affixed to the back 62 of the display means 14 as is shown more particularly in FIG. 6. It will be recognized by those skilled in the art that by constructing the fastening means 58 and 60 so that one thereof is a male and the other a female of known releasable fastening structures such as Velcro or the like that the display unit 14 may be removably attached to the outer planar surface 36 of the base unit. Such removability may be desired for the purpose of substituting the material 17 being displayed within the display unit 14 or alternatively to replace one display unit 14 with a different display unit 14 as may be desired from time to time. Although Velcro has been specified other known mounting means may be utilized to provide removability and replacement of the display unit 14. For example, an alternative mounting means is double faced foam tape.

It will be recognized by those skilled in the art that the swing arms 22 and 26 along with the illumination means 16 and its component parts will, when the swing arms are fully extended away from the wall 12, provide a substantial weight which must be supported by the top wall 42 of the base unit 32. Unless the top wall 42 is of substantially heavy gage metal it will tend to bend which would be unacceptable. Therefore means for reinforcing the top wall 42 must normally be provided.

Figure 5:
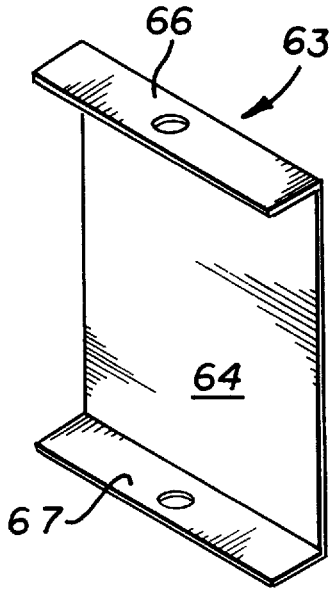
FIG. 5 is a perspective view of a reinforcing plate which may be inserted within the base.

There is shown in FIG. 5 one means for providing reinforcement for the top wall 42. As is shown in FIG. 5 there is provided a flat plate 64 having a top member 66 and a bottom member 67 extending orthoganally therefrom. The flat plate 64 would be inserted so as to be juxtaposed the front wall inner surface 34 of the base unit with the bottom member 67 extending coextensive with the bottom wall 44 of the base unit and the top member 66 extending coextensive with the top wall 42 of the base unit 32. If the reinforcing plate is to be used it will be inserted into the opening provided in the base plate as shown in FIG. 2 before the rear cover plate 46 is secured in place and before the conduit means 70 is secured in place. Appropriate fastening means would be provided to secure the reinforcing plate 63 in place as above described. Such means could include an adhesive such as epoxy or, alternatively, an appropriate riveting, screw fasteners or the like.

In addition, a conduit means such as the nipple 70 may be extended between the top and bottom walls 42 and 44 of the base unit 32. The conduit functions to carry the electrical leads as shown at 72 between the electrical outlet and the lamp. Typically the conduit would be a threaded nipple and would be interrupted as illustrated to define spaced apart ends 74 and 76. The spaced apart ends would provide the ability for easy access to the electrical leads 72 so that those extending from the lamp may be easily connected to those extending from the electrical outlet as shown. In order to provide rigidity of the conduit means 70 extending between the top wall 42 and the bottom wall 44, a U-shaped bracket 78 is attached by means of appropriate nuts between the spaced apart ends 74 and 76. Appropriate nuts and couplings are utilized to attach each end of the conduit 70 as shown for example at 80 and 82 to the bottom and top walls 44 and 42 of the base unit 32 respectively. By such rigid attachment along with the U-shaped coupling means 78 which bridges the spaced apart ends a continuous rigid conduit means is utilized which also will provide reinforcement to support the weight of the swing arms 22 and 26 and the illumination means 16 even when fully extended from the wall 12.

As will be apparent to those skilled in the art the present invention provides the combination of a lamp along with a display unit which may be integrally connected together to provide a means for displaying a desired item and simultaneously illuminating the same while also utilizing the illumination from the illumination means for other purposes such as reading or to provide light to the general area.

What is claimed is:

1. A lamp having a removable display unit containing an item for being illuminated by said lamp comprising:

(A) a base unit having a planar outer surface;

(B) a swing arm stem extending from said base unit;

(C) a display unit containing an item to be illuminated;

(D) illumination means affixed to said stem and being adjustable to illuminate said item, said swing arm and illuminating means having a weight;

(E) reinforcing means included within said base unit for supporting the weight of said swing arm and said illumination means; and (F) a plurality of mounting means for removably attaching said display unit to said planar outer surface.

2. A lamp as defined in claim 1 wherein said base unit includes a front wall defining an inner surface and said planar outer surface with bottom, top and side walls extending orthogonally from said front wall inner surface, said reinforcing means includes a flat plate extending coextensive with said front wall inner surface and having top and bottom members extending orthogonally from said flat plate and coextensive with said top and bottom walls of said base unit, and a back cover affixed to said base unit.

3. A lamp as defined in claim 2 wherein said plurality of mounting means includes male attaching fingers affixed to one of said planar outer surface and said display unit and female attaching receivers affixed to the other of said planar outer surface and said display unit.

4. A lamp as defined in claim 4 which further includes a coupling means extending through said top wall and said top member with said swing arm affixed to said coupling means.

5. A lamp having a removable display unit comprising:

(A) a base unit having a planar outer surface, top and bottom walls extending orthogonally to said planar outer surface;

(B) a stem extending from said base unit;

(C) illumination means affixed to said stem;

(D) a display unit;

(E) conduit means extending through said base unit between said top and bottom walls and rigidly affixed therebetween; and (F) a plurality of mounting means for removably attaching said display unit to said planar surface.

6. A lamp as defined in claim 5 wherein said conduit means is interrupted within said base unit between said top and bottom walls to define spaced apart ends for ease in attaching electrical wire to said illumination means.

7. A lamp as defined in claim 6 which further includes a bracket interconnecting said spaced apart ends to maintain reinforcing integrity of said conduit means.

* * * * *